US008171682B2

(12) United States Patent
Pulcini et al.

(10) Patent No.: US 8,171,682 B2
(45) Date of Patent: May 8, 2012

(54) FRAMELESS WINDOW AND PROCESS FOR ITS MANUFACTURE

(75) Inventors: Sergio Pulcini, Volpiano (IT); Christoph Senge, Dillingen (DE)

(73) Assignees: Pilkington Italia S.p.A., San Salvo (IT); Pilkington Automotive Deutschland GmbH, Witten (DE)

( * ) Notice: Subject to any disclaimer, the term of this patent is extended or adjusted under 35 U.S.C. 154(b) by 109 days.

(21) Appl. No.: 12/519,695

(22) PCT Filed: Dec. 19, 2007

(86) PCT No.: PCT/EP2007/064178

§ 371 (c)(1), (2), (4) Date: Jun. 17, 2009

(87) PCT Pub. No.: WO2008/074819

PCT Pub. Date: Jun. 26, 2008

(65) Prior Publication Data

US 2010/0037543 A1 Feb. 18, 2010

(30) Foreign Application Priority Data

Dec. 19, 2006 (EP) ..... 06425847

(51) Int. Cl.

| | |
|---|---|
| ***E06B 3/00*** | (2006.01) |
| ***E06B 3/68*** | (2006.01) |
| ***E06B 3/964*** | (2006.01) |
| ***E06B 3/988*** | (2006.01) |

(52) U.S. Cl. ..... 52/208; 52/204.5; 52/204.6; 52/204.62; 52/204.63; 52/204.68; 52/204.7; 52/204.71

(58) Field of Classification Search ..... 52/208, 52/204.5, 204.6, 204.62, 204.63, 204.68, 52/204.7, 204.71, 204.72

See application file for complete search history.

(56) References Cited

U.S. PATENT DOCUMENTS

| | | | | |
|---|---|---|---|---|
| 3,832,274 | A | 8/1974 | Owston et al. | |
| 4,026,088 | A * | 5/1977 | Akabane | 52/716.5 |
| 4,803,257 | A * | 2/1989 | Goel | 528/45 |
| 4,987,699 | A * | 1/1991 | Gold | 49/375 |
| 5,546,704 | A * | 8/1996 | Maruoka | 49/375 |
| 5,987,820 | A * | 11/1999 | Shibanushi | 49/375 |

(Continued)

FOREIGN PATENT DOCUMENTS

DE 3932724 A1 4/1991

(Continued)

OTHER PUBLICATIONS

Machine Translation From the EPO website (obtained Jan. 19, 2011) of WO 01/98613 specification.*

(Continued)

*Primary Examiner* — Mark Wendell

(74) *Attorney, Agent, or Firm* — Buchanan Ingersoll & Rooney PC

(57) ABSTRACT

Frameless window which comprises a transparent pane, the lower edge of which is fixed in the slot of one or more holders by at least one layer of adhesive and is joined to the walls of the slot of the holders by at least two layers of a first adhesive applied close to the lateral ends of the slot, wherein at least one layer of a second adhesive is applied in the slot between the layers of the first adhesive. A process for manufacturing the window is also disclosed.

20 Claims, 6 Drawing Sheets

U.S. PATENT DOCUMENTS

| | | | | |
|---|---|---|---|---|
| 6,247,218 | B1 | 6/2001 | Saunus et al. | |
| 6,349,504 | B1 * | 2/2002 | Schmitt | 49/375 |
| 6,425,207 | B1 * | 7/2002 | Davis | 49/375 |
| 6,729,073 | B2 * | 5/2004 | Nicolai | 49/375 |
| 6,966,149 | B2 * | 11/2005 | Fenelon | 49/375 |
| 2003/0056458 | A1 * | 3/2003 | Black et al. | 52/541 |
| 2006/0032175 | A1 * | 2/2006 | Chen et al. | 52/578 |
| 2006/0048452 | A1 * | 3/2006 | Sweeney et al. | 49/374 |
| 2010/0038010 | A1 | 2/2010 | Pulcini et al. | |

FOREIGN PATENT DOCUMENTS

| | | | |
|---|---|---|---|
| DE | 4203364 | A1 | 8/1993 |
| DE | 4336107 | A1 | 4/1995 |
| DE | 43 40 363 | A1 | 6/1995 |
| DE | 19728580 | A1 | 1/1998 |
| DE | 19902059 | A1 | 6/1999 |
| DE | 19808916 | A1 | 9/1999 |
| DE | 10044845 | A1 | 4/2002 |
| DE | 10049768 | A1 | 4/2002 |
| DE | 102004015052 | A1 | 10/2005 |
| EP | 0173091 | A2 | 3/1986 |
| EP | 0878336 | A2 | 11/1998 |
| EP | 1123858 | A1 | 8/2001 |
| EP | 1239016 | A1 | 9/2002 |
| EP | 1403108 | A1 | 3/2004 |
| EP | 1617028 | A1 | 1/2006 |
| FR | 2 762 350 | A1 | 10/1998 |
| WO | 99/31396 | A1 | 6/1999 |
| WO | WO 01/98613 | A2 | 12/2001 |
| WO | WO 2004/016894 | A2 | 2/2004 |

OTHER PUBLICATIONS

Form PCT/ISA/210 (International Search Report) dated Mar. 13, 2008.

European Search Report dated May 25, 2007 in corresponding European Patent Application No. 06 42 5845.

European Search Report dated Jun. 27, 2007 in corresponding European Patent Application No. 06 42 5846.

* cited by examiner

FRAMELESS WINDOW AND PROCESS FOR ITS MANUFACTURE

TECHNICAL FIELD

The present invention relates to a frameless window, in particular a mobile window for motor vehicles. The present invention also relates to a process for manufacturing said window. The window comprises a pane of glazing material such as a sheet of glass.

BACKGROUND

A frameless window is a window in which the pane is not surrounded by a frame for at least a significant part of the time during normal use. One example which is particularly relevant is that of a frameless window for a door of a motor vehicle, especially the front door of a sports car such as a coupe, convertible or other vehicle lacking a B pillar. A B pillar is the bodywork member which separates the front windows from the rear windows of a vehicle. In a vehicle door having a frameless window, no window frame is provided in the door itself, so when the door is open, the pane extends upwards from the door without lateral support. However, when the door is shut, the pane is received against seals in the vehicle bodywork, and is normally surrounded by such bodywork, and to that extent the window may not be regarded as entirely frameless.

It will be appreciated that, given the lack of lateral support for the pane, it is important to achieve precise positioning of the pane relative to the door, so that the pane comes into sealing contact with the bodywork seals when the door is shut. The lower edge of the pane is held in members known as holders, which generally have a U-shaped configuration, and may be bonded to the pane.

WO 01/98613 discloses a process and an apparatus for manufacturing frameless windows which comprise a glass pane, the lower edge of which is fixed by means of adhesives in the slot of one or more holders. These windows, already provided with said holders, are arranged onto a work-table in a substantially horizontal position. A portion of these holders is removed when the windows lie on the work-table, so as to compensate the shape variations of the glass pane with respect to its nominal shape. These shape variations can also be compensated by slightly modifying the mutual position of the pane with respect to the holders by exploiting the minimum gap which is comprised in the slot between the pane and the holders for applying the adhesives between them.

Similar windows and manufacturing arrangements are also disclosed in DE 4340363, FR 2762350 and WO 2004/016894.

However, in all the above mentioned known windows, the possibility of compensating the shape variations of the glass pane is very low since the high precision and the short manufacturing times required for mounting the window do not allow to employ holders with relatively wide slots.

SUMMARY

It is therefore an object of the present invention to manufacture frameless windows by compensating in a simple and fast manner their shape variations with respect to the nominal shape. Said object is achieved with a window and a process, the main features of which are disclosed in claims 1 and 9, respectively, while other features are disclosed in the remaining claims.

The invention further relates to a window comprising a pane of sheet glazing material and one or more holders bonded to the pane, each holder having an elongate slot, characterised in that the lower edge of the pane is bonded in position in the slot by a first adhesive applied locally to part of the slot and a second adhesive applied to the slot adjacent the first adhesive. Preferably the first adhesive is applied close to one or both ends of the slot. Application of the adhesive may be direct to the slot, or adhesive may be applied to the pane first, and hence indirectly to the slot.

Thanks to the holders with relatively wide slots which are partially filled with a first adhesive having a high elastic modulus and a short cure time, the window according to the present invention can be assembled quickly, since said adhesive can keep the glass pane in the correct position with respect to the holders also when their slot is much wider than the thickness of the pane. After the application of the first adhesive, the slots can be filled with a second adhesive which completes the structural union between the pane and the holders. This second adhesive can have a lower elastic modulus and a longer cure time, since it can be applied when the holders are already fixed to the pane. The viscosity of the second adhesive is preferably lower than the viscosity of the first adhesive, so as to simplify the application of the second adhesive, since the latter can be poured in a liquid form in the slots of the holders without leaking, because it is contained laterally by the layers of the first adhesive already cured.

The process according to the present invention can be carried out by means of a particular system which simplifies and speeds up the manufacture of the window according to the present invention. In particular, said system comprises a first apparatus for applying the first adhesive and a second apparatus for applying the second adhesive, so as to manufacture the windows in two distinct steps for optimizing the manufacturing times and costs.

BRIEF DESCRIPTION OF THE DRAWINGS

Further advantages and features of the window and the process according to the present invention will become clear to those skilled in the art from the following detailed and non-limiting description of an embodiment thereof with reference to the attached drawings, wherein.

DETAILED DESCRIPTION

Figure 1:
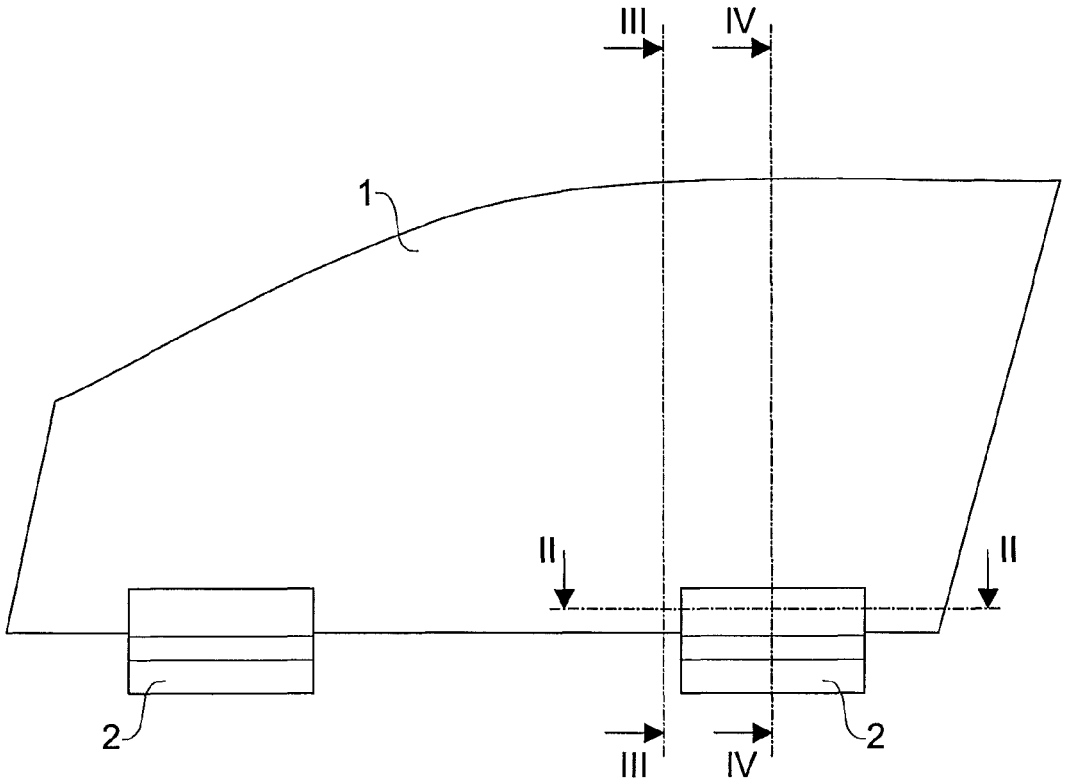
FIG. 1 shows a side view of the window.

FIG. 1 shows a frameless window comprising a pane of glass 1 and two holders 2. The holders 2 are generally in the form of elongate channels, i.e. with walls either side of an elongate slot, and so have a U-shaped cross-section. The ends of the channel are open. Each holder normally has a leg or similar appendage (shown in FIGS. 3 to 5) extending downwards from the holder (in the normal orientation as shown in FIG. 1) to act as a coupling member for attaching the holder to a window lift mechanism (not shown). The holders are normally made of plastic.

Still referring to FIG. 1, it is seen that the frameless window according to the present invention comprises in a known way a transparent pane, in particular a glass pane 1, generally bent inwards, the lower edge of which is inserted in the slot of one or more holders 2 which are suitable for supporting pane 1 and are provided with coupling members (not shown in the figures) for the mechanical connection to lifting devices, for example arranged in the door of a motor vehicle.

Figure 2:
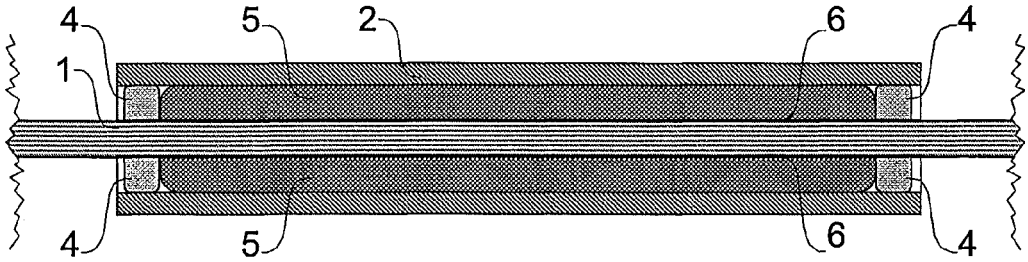
FIG. 2 shows an enlarged view sectioned along plane II-II of FIG. 1.
Figure 3:
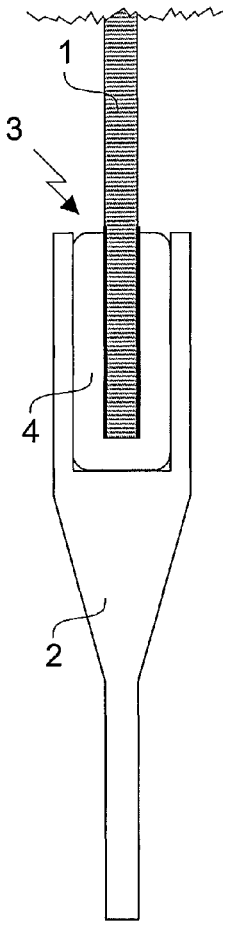
FIG. 3 shows an enlarged view sectioned along plane III-III of FIG. 1.
Figure 4:
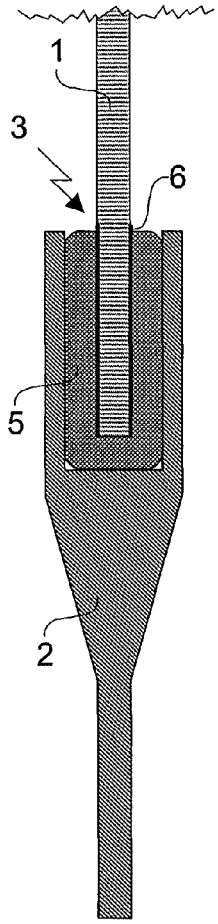
FIG. 4 shows an enlarged view sectioned along plane IV-IV of FIG. 1.

Referring to FIGS. 2 to 4, it is seen that the lower edge of pane 1 is separated from the walls of slot 3 of holders 2 and is joined thereto by means of one or more layers of a first adhesive 4 applied close to the lateral ends of slot 3, wherein at least one layer of a second adhesive 5 is applied in slot 3 between the layers of the first adhesive 4. A layer of primer 6 can be applied on the two faces of the lower edge of pane 1 before applying the layers of adhesive 4 and 5.

The first adhesive 4 is a hotmelt polyurethane adhesive, while the second adhesive 5 is a two-component polyurethane adhesive which can be applied at room temperature. The viscosity and the elastic modulus of the first adhesive 4 are higher than the viscosity and the elastic modulus, respectively, of the second adhesive 5, while the cure time of the first adhesive 4 is shorter than the cure time of the second adhesive 5.

Figure 5:
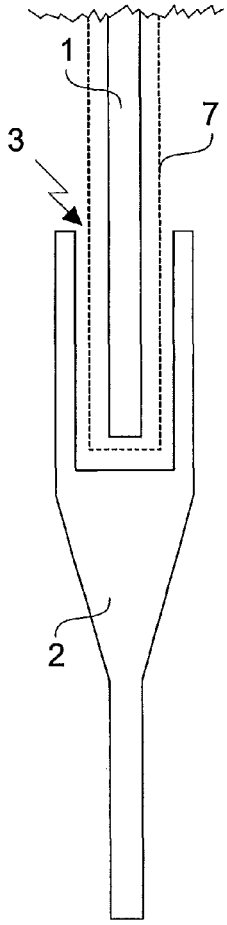
FIG. 5 shows a schematic view of the window of FIG. 4.

Referring to FIG. 5, it is seen that the width of slots 3 of holders 2 is at least twice the thickness of pane 1, so that the latter can be arranged in a variable position within a tolerance zone 7 (shown with broken lines) separated and distant from the inner walls of slots 3. In particular, with a pane 1 having a thickness comprised between 3 and 6 mm, the average width of the tolerance zone 7 is comprised between 6 and 10 mm, while the average width of slot 3 is comprised between 8 and 14 mm. The tolerance zone 7 further includes 1 mm of space downwards, while the average distance between the lower border of the tolerance zone 7 and the bottom of slot 3 is comprised between 1 and 3 mm. The depth of slot 3 is greater than 10 mm, in particular comprised between 31 and 33 mm.

Figure 6:
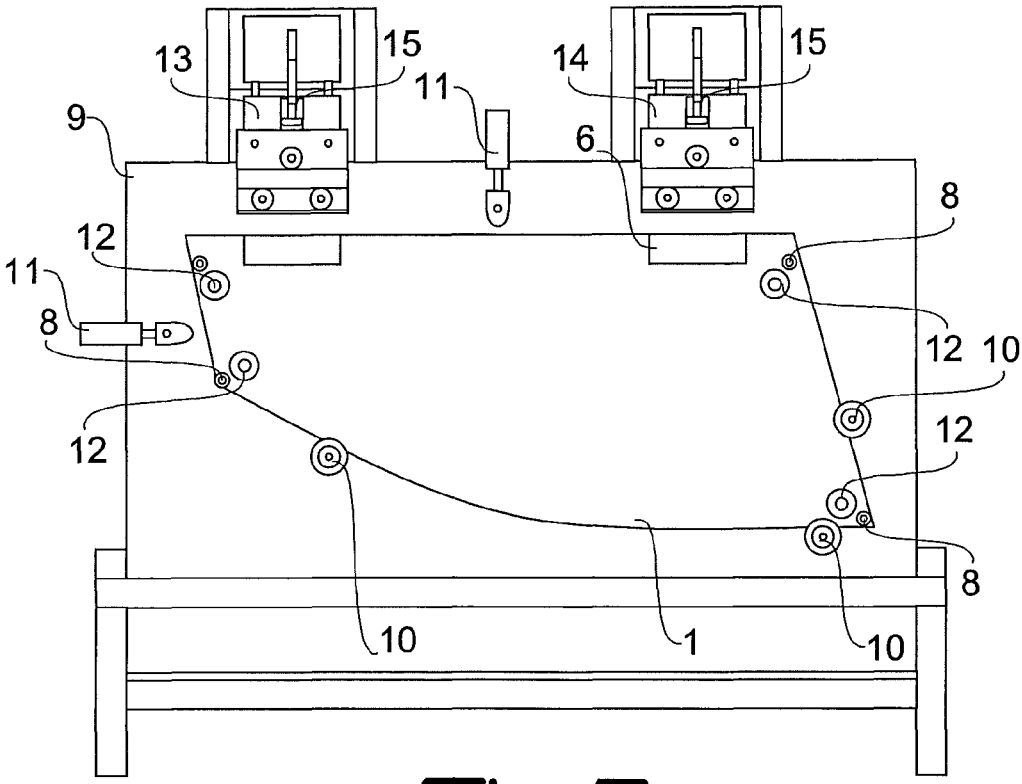
FIG. 6 shows a view perpendicular to the work-table of the first apparatus during a first operating step of the process.
Figure 7:
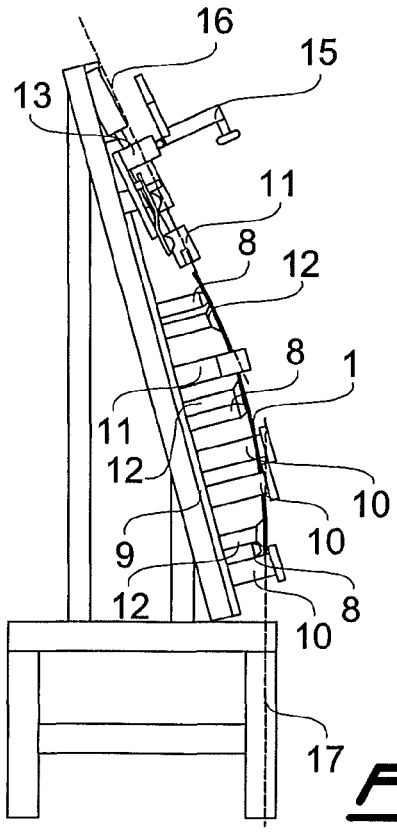
FIG. 7 shows a side view of the apparatus of FIG. 6.

Referring to FIGS. 6 and 7, it is seen that in a first operating step of the process according to the present invention, pane 1, already provided with primer 6, is arranged in a vertical or inclined position with the lower edge turned upwards on the first apparatus of the system according to the present invention, which comprises in a known way a plurality of reference supports 8 arranged on a work-table 9. The ends of these reference supports 8 contacting pane 1 are arranged in determined points which are in the same position in space of reference points employed for mounting the window in a motor vehicle. In particular, four reference supports 8 are arranged on work-table 9 in positions corresponding to the four corners of pane 1. The work-table 9 comprises a plurality of rollers 10 which contain laterally or support from the bottom the edges of pane 1. One or more pushers 11 are mounted on work-table 9 for urging pane 1 against rollers 10. In particular, a first pusher 11 is arranged on the upper portion of work-table 9 and a second pusher 11 is arranged on one side of work-table 9. A plurality of suction caps 12 are mounted on work-table 9 for pulling pane 1 against the reference supports 8. Two mobile supports 13, 14 are arranged on the upper portion of work-table 9 for moving holders 2 toward the lower edge, turned upwards, of pane 1. The mobile supports 13, 14 are also provided with a plurality of reference supports and with a lever vice 15 for locking in a determined position holders 2 on these reference supports. The mobile supports 13, 14 can be driven by pneumatic pistons along a plane 16 tangent to the lower edge, turned upwards, of pane 1, which plane 16 forms an angle lower than 20° with work-table 9. Work-table 9 is inclined so that a plane 17 tangent to the upper edge turned downwards of pane 1 forms an angle lower than 30°, in particular lower than 5°, with a vertical plane. Work-table 9 forms in turn an angle lower than 30° with a vertical plane.

Figure 8:
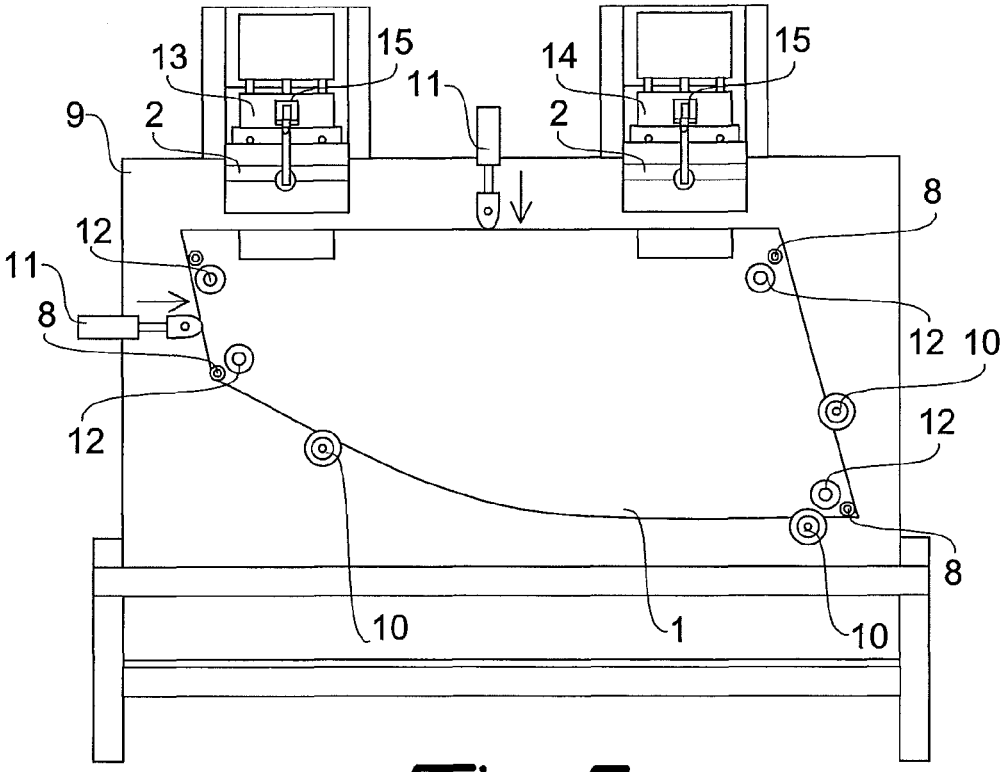
FIG. 8 shows a view perpendicular to the work-table of the first apparatus during a second operating step of the process.
Figure 9:
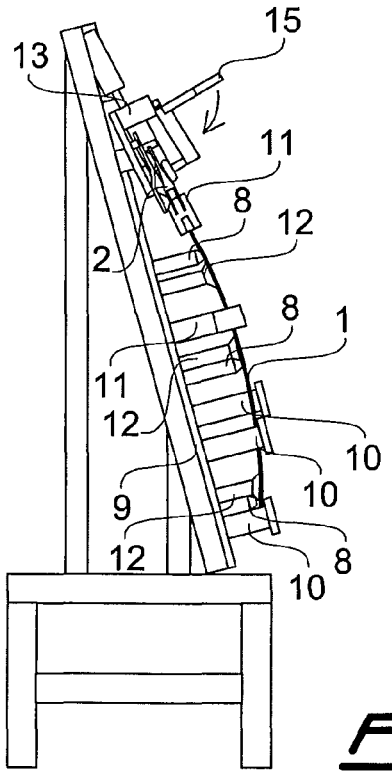
FIG. 9 shows a side view of the apparatus of FIG. 8.

Referring to FIGS. 8 and 9, it is seen that in a second operating step of the process according to the present invention pane 1 is locked by pushers 11 and by suction cups 12 on work-table 9, while holders 2 are locked on the mobile supports 13, 14 by the lever vices 15.

Figure 10:
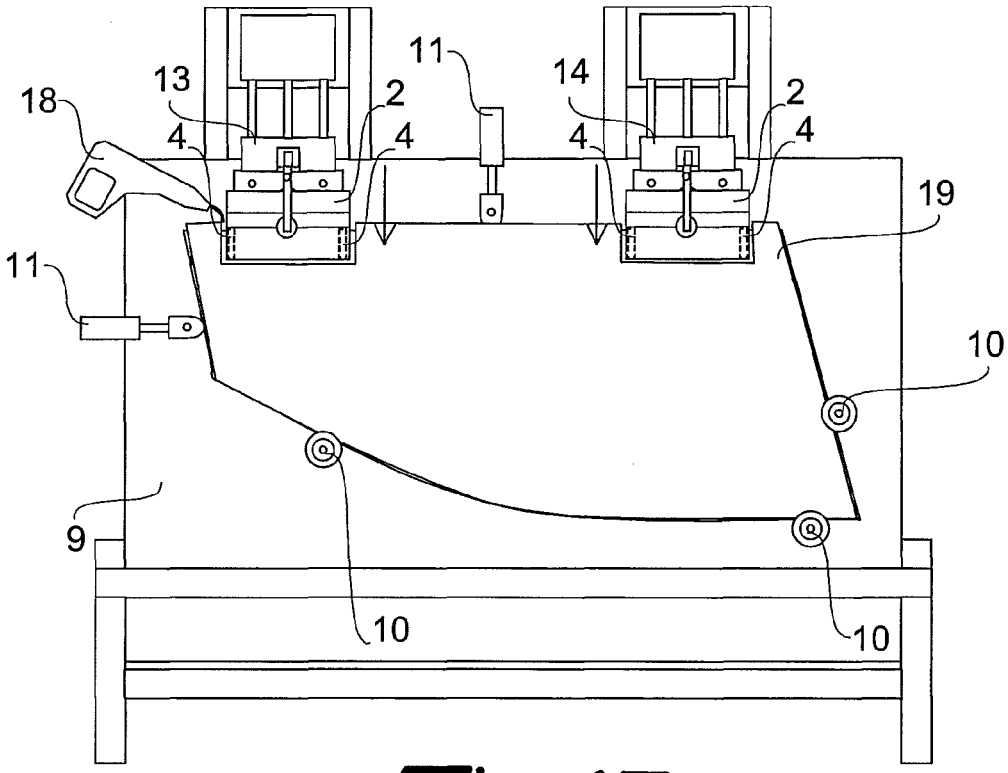
FIG. 10 shows a view perpendicular to the work-table of the first apparatus during a third operating step of the process.
Figure 11:
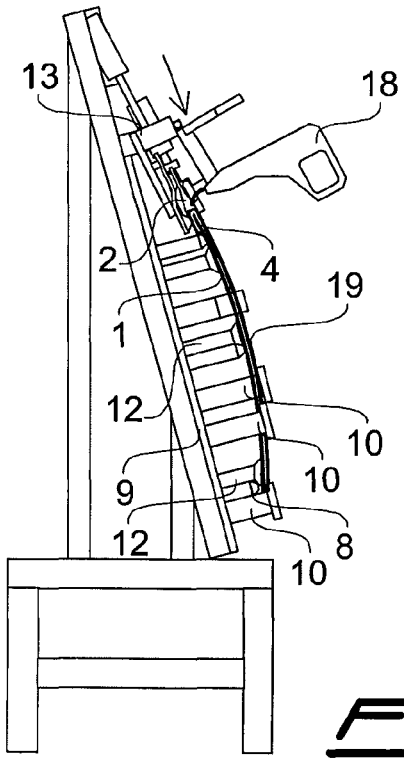
FIG. 11 shows a side view of the apparatus of FIG. 10.

Referring to FIGS. 10 and 11, it is seen that in a third operating step of the process according to the present invention holders 2 are moved downwards toward pane 1 by the mobile supports 13, 14, so that holders 2 are inserted astride the lower edge of pane 1, after which the layers of the first adhesive 4 (shown with broken lines in FIG. 10), heated at a temperature comprised between 110 and 130° C., are applied to the lateral ends of slots 3 of holders 2 by means of a heating applicator 18 provided with a curved nozzle, so as to easily reach the edges of slots 3 arranged behind pane 1. A protective screen 19 suitable to cover pane 1, thereby leaving holders 2 uncovered, is arranged onto pane 1 before the application of the first adhesive 4. When the first adhesive 4 has reached a suitable cure time, i.e. when the first adhesive 4 can firmly support holders 2 in their position with respect to pane 1, the lever vices 15 are opened, the mobile supports 13, 14 are lifted, screen 19 is removed and pane 1 is separated from work-table 9.

Figure 12:
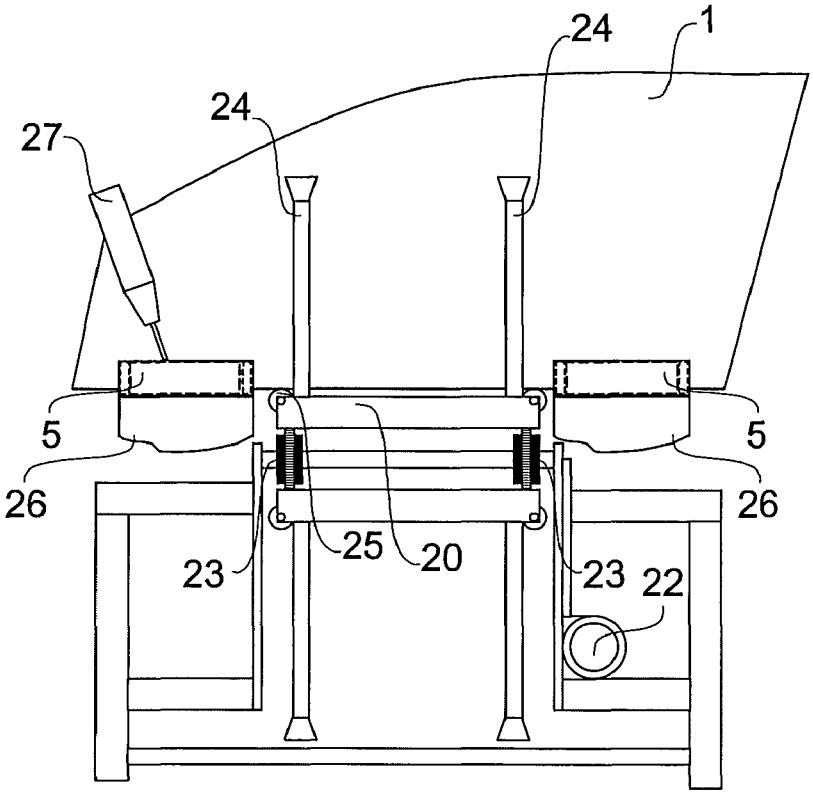
FIG. 12 shows a front view of the second apparatus during a fourth operating step of the process.
Figure 13:
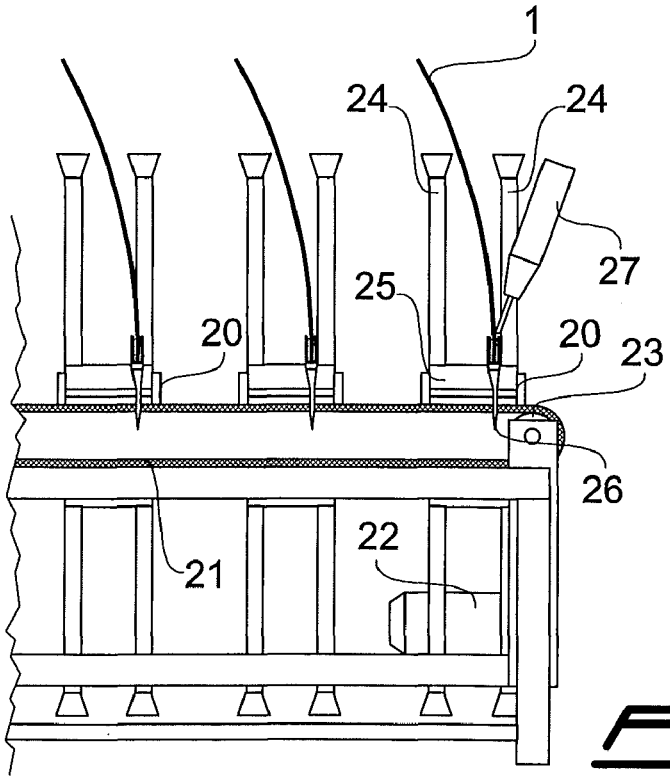
FIG. 13 shows a partial side view of the apparatus of FIG. 12.

Referring to FIGS. 12 and 13, it is seen that in a fourth operating step of the process according to the present invention pane 1 provided with holders 2 is arranged with the lower edge turned downwards on a carriage 20 of the second apparatus of the system according to the present invention, which comprises a series of carriages 20 suitable for moving horizontally in a direction substantially perpendicular to pane 1. For this purpose, carriages 20 are fixed to a conveying device comprising one or more chains 21 driven by an electric motor 22 by means of toothed wheels 23, so that a first half of carriages 20 can run in a longitudinal direction, while the second half of carriages 20 runs under the first half in the opposite direction. Each carriage 20 comprises a plurality of vertical supports 24, for example two pairs of bars, between which one pane 1 is arranged. Each carriage 20 also comprises a plurality of rollers 25 which support pane 1, thereby allowing a transversal sliding thereof with respect to carriage 20. The vertical supports 24 are arranged between the holders 2 fixed to pane 1. A protective sheath 26, for example a rubber glove, is put on holders 2, after which a mixing applicator 27 pours from the top the second adhesive 5 (shown with broken lines in FIG. 12) into slot 3 of holders 2 of pane 1 on the first carriage 20 arranged at the beginning of the series of carriages, until slot 3 is filled with the second adhesive 5, which is contained laterally in slot 3 by the two layers of the first adhesive 4 arranged at the lateral ends of slot 3. At the end of the application of the second adhesive 5, carriage 20 is moved longitudinally, so that a free carriage is arranged at the beginning of the series for receiving a new pane.

The invention claimed is:

1. Frameless window which comprises a transparent pane having a lower edge fixed in a slot of at least one holder by two adhesives that include a first adhesive and a second adhesive, the holder possessing oppositely located first and second ends, with the slot extending between the first and second ends, wherein the lower edge of the pane is joined to a wall of the slot of the at least one holder by at least two layers of the first adhesive, wherein at least one layer of the second adhesive is applied in the slot between the two layers of the first adhesive, the second adhesive being contained laterally by the two layers of the first adhesive, one layer of the first adhesive being positioned between the second adhesive and the first end of the holder, and the other layer of the first adhesive being positioned between the second adhesive and the second end of the holder.

2. Window according to claim 1, wherein the pane is arranged in a variable position within a tolerance zone separated and distant from the inner walls of the slot.

3. Window according to claim 1, wherein the first adhesive is a hotmelt polyurethane adhesive.

4. Window according to claim 1, wherein the second adhesive is a two-component polyurethane adhesive.

5. Window according to claim 1, wherein the second adhesive is applied at room temperature.

6. Window according to claim 1, wherein the viscosity of the first adhesive is higher than the viscosity of the second adhesive.

7. Window according to claim 1, wherein the elastic modulus of the first adhesive is higher than the elastic modulus of the second adhesive.

8. Window according to claim 1, wherein the cure time of the first adhesive is shorter than the cure time of the second adhesive.

9. Process for manufacturing frameless windows which comprise a transparent pane, the lower edge of which is fixed in a slot of at least one holder by two adhesives including first and second adhesives, the holder possessing oppositely located first and second ends, with the slot extending between the first and second ends, the process comprising:

arranging the lower edge of the pane in the slot of the holders at least one holder;

applying at least two layers of the first adhesive in the slot of the at least one holder; and applying at least one layer of the second adhesive in the slot of the at least one holder between the two layers of the first adhesive in liquid form, the second adhesive being contained laterally by the two layers of the first adhesive, one layer of the first adhesive being positioned between the second adhesive and the first end of the holder, and the other layer of the first adhesive being positioned between the second adhesive and the second end of the holder.

10. Process according to claim 9, wherein the first adhesive is a hotmelt polyurethane adhesive.

11. Process according to claim 10, wherein the first adhesive is applied at a temperature comprised between 110 and 130° C.

12. Process according to claim 9, wherein the lower edge of the pane is turned upwards when the first adhesive is applied.

13. Process according to claim 9, wherein the second adhesive is a two-component polyurethane adhesive.

14. Process according to claim 13, comprising applying the second adhesive at room temperature.

15. Process according to claim 9, wherein the lower edge of the pane is turned downwards when the second adhesive is applied.

16. Process according to claim 9, wherein the viscosity of the first adhesive is higher than the viscosity of the second adhesive.

17. Process according to claim 9, wherein the elastic modulus of the first adhesive is higher than the elastic modulus of the second adhesive.

18. Process according to claim 9, wherein the cure time of the first adhesive is shorter than the cure time of the second adhesive.

19. The frameless window of claim 9, wherein viscosities of the one layer of the first adhesive and the other layer of the first adhesive differs from the viscosity of the second adhesive.

20. A frameless window comprising:

a holder possessing a slot, a first surface and a second surface;

a pane possessing a lower edge positioned within the slot, wherein a first surface of the pane faces toward the first surface of the slot and the second surface of the pane faces toward a second surface of the slot;

one layer of a first adhesive contacting the first surface of the pane, the second surface of the pane, the first surface of the slot and the second surface of the slot;

an other layer of the first adhesive laterally spaced from the one layer of the first adhesive, the other layer of the first adhesive contacting the first surface of the pane, the second surface of the pane, the first surface of the slot and the second surface of the slot;

a second adhesive different from the first adhesive, the second adhesive being positioned between the one layer of the first adhesive and the other layer of the first adhesive; and the second adhesive contacting the first surface of the pane, the second surface of the pane, the first surface of the slot and the second surface of the slot.

* * * * *